US009517381B2

(12) United States Patent
Liptack

(10) Patent No.: US 9,517,381 B2
(45) Date of Patent: Dec. 13, 2016

(54) MEDICAL LEG SUPPORT ARRANGEMENT ADAPTED TO INCREASE THE RANGE OF MOTION OF A LEG TO AID IN THE HEALING AND STRENGTHENING OF DAMAGED, INJURED AND/OR REPLACED BONE, MUSCLE AND/OR TISSUE OF THE LEG

(71) Applicant: MAXM SKATE PTY LTD, Brighton (AU)

(72) Inventor: Matthew Liptack, Brighton (AU)

(73) Assignee: Maxm Skate Pty. Ltd. (AU)

( * ) Notice: Subject to any disclaimer, the term of this patent is extended or adjusted under 35 U.S.C. 154(b) by 0 days.

(21) Appl. No.: 14/439,018

(22) PCT Filed: Oct. 28, 2013

(86) PCT No.: PCT/AU2013/001248

§ 371 (c)(1),
(2) Date: Apr. 28, 2015

(87) PCT Pub. No.: WO2014/066933

PCT Pub. Date: May 8, 2014

(65) Prior Publication Data

US 2015/0343261 A1 Dec. 3, 2015

(30) Foreign Application Priority Data

Oct. 29, 2012 (AU) ..... 2012904685

(51) Int. Cl.
*A63B 22/20* (2006.01)
*A63B 23/08* (2006.01)
(Continued)

(52) U.S. Cl.
CPC ..... *A63B 23/08* (2013.01); *A63B 21/0004* (2013.01); *A63B 21/00185* (2013.01);
(Continued)

(58) Field of Classification Search
CPC . A63B 6/00; A63B 21/0004; A63B 21/00043; A63B 21/00061; A63B 21/00065; A63B 21/00069; A63B 21/00072; A63B 21/00076; A63B 21/00178; A63B 21/00185; A63B 21/00189; A63B 21/012; A63B 21/0125; A63B 21/015; A63B 21/02; A63B 21/028; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/0608; A63B 21/065; A63B 21/068; A63B 21/08; A63B 21/15; A63B 21/151; A63B 21/16; A63B 21/22; A63B 21/225; A63B 21/227; A63B 21/4015; A63B 21/4025; A63B 21/4033; A63B 21/4034; A63B 21/4035; A63B 21/4037; A63B 21/4039; A63B 21/4045; A63B 21/4049; A63B 2022/0094; A63B 2022/185; A63B 2022/206; A63B 22/16; A63B 22/18; A63B 22/20; A63B 22/201; A63B 22/203; A63B 23/04; A63B 23/0494; A63B 23/08; A63B 23/085; A63B 69/0022; A63B 69/0035; A63B 69/0057; A63B 69/0059; A63B 69/18; A63B 69/182; A63B 2069/0062; A63B 71/0009; A63B 71/0054; A63B 2071/0018; A63B 2071/0063; A63B 2071/0072; A63B 2071/0081; A63B 2071/009; A63B 2208/0209; A63B 2208/0233; A63B 2244/18; A63B 2244/186; A63B 2244/19; A63B 21/4011; A63B 21/4043; A63B 22/0061; A63B 2023/006; A63C 17/004; A63C 17/006;A63C 17/0073; A63C 17/04; A63C 17/045; A43B 13/00; A43B 13/14; A43B 13/141; A43B 13/143; A43B 13/145; A43B 13/146
(Continued)

(56) References Cited

U.S. PATENT DOCUMENTS 1,260,692 A * 3/1918 Madsen ..... A63C 17/06 280/11.222
1,868,548 A 7/1932 Turner
(Continued)

*Primary Examiner* — Oren Ginsberg
*Assistant Examiner* — Gary D Urbiel Goldner
(74) *Attorney, Agent, or Firm* — Renner Kenner Greive Bobak Taylor & Weber

(57) ABSTRACT

A medical leg support arrangement includes a main housing having a platform that a foot of a user would rest and be fastened there upon. Rotatable ground engaging strips are provided on opposing sides of the platform, wherein each rotatable ground engaging strip includes curved and/or arched up distal ends such that when in use weight bearing support of the arrangement is maintained upon initial contact and departure of the arrangement from the ground so as to allow continuous support to the leg of the user during back and forth circumferential motion instigated by the user when ground engaging the arrangement.

10 Claims, 6 Drawing Sheets

(51) Int. Cl.

| | |
|---|---|
| ***A63B 22/16*** | (2006.01) |
| ***A63B 21/00*** | (2006.01) |
| ***A63B 23/04*** | (2006.01) |
| *A63B 21/04* | (2006.01) |
| *A63B 21/055* | (2006.01) |
| *A63B 22/00* | (2006.01) |
| *A63B 21/02* | (2006.01) |
| *A63B 23/035* | (2006.01) |

(52) U.S. Cl.
CPC ..... *A63B 21/4015* (2015.10); *A63B 21/4034* (2015.10); *A63B 21/4049* (2015.10); *A63B 22/16* (2013.01); *A63B 22/20* (2013.01); *A63B 23/0494* (2013.01); *A63B 21/00061* (2013.01); *A63B 21/00181* (2013.01); *A63B 21/028* (2013.01); *A63B 21/0442* (2013.01); *A63B 21/0552* (2013.01); *A63B 21/4037* (2015.10); *A63B 23/03508* (2013.01); *A63B 2022/0094* (2013.01); *A63B 2208/0233* (2013.01)

(58) Field of Classification Search
USPC ..... 36/102, 103, 114, 115
See application file for complete search history.

(56) References Cited

U.S. PATENT DOCUMENTS 1,988,055 A * 1/1935 Stein ..... F04B 43/14 280/11.222
2,430,037 A * 11/1947 Vincent ..... A63C 17/04 280/11.209
3,767,220 A * 10/1973 Peterson ..... A63C 17/045 280/11.215
4,463,947 A * 8/1984 Kloenne ..... A61H 1/024 482/139
4,923,192 A * 5/1990 Sawdon ..... A63B 21/0602 482/51
5,207,438 A * 5/1993 Landers ..... A63C 17/1436 188/5
5,398,950 A * 3/1995 Tkaczyk ..... A63C 17/045 280/11.233
5,509,870 A * 4/1996 Lloyd ..... A63B 21/4037 434/253
5,671,931 A * 9/1997 Su ..... A63C 17/0073 280/11.19
5,832,560 A * 11/1998 DePalma ..... A61F 13/041 16/30
6,375,204 B1 * 4/2002 Tu ..... A63B 22/16 280/11.27
6,425,844 B1 7/2002 Azar
6,551,221 B1 * 4/2003 Marco ..... A63B 21/0004 280/600
7,004,892 B2 * 2/2006 Marco ..... A63B 21/0004 434/258
7,063,335 B1 6/2006 Galeev
7,618,356 B1 * 11/2009 Johnson ..... A43B 3/0042 36/136
7,854,435 B2 * 12/2010 Campbell ..... B62B 3/008 180/65.1
8,336,892 B2 * 12/2012 Croskey ..... A63C 17/1436 280/11.209
8,864,632 B2 * 10/2014 Johnson ..... A63B 21/0442 482/124
2004/0209739 A1 * 10/2004 Lammers ..... A61F 13/067 482/51
2005/0096201 A1 * 5/2005 Thelen ..... A63B 21/055 482/124
2006/0040807 A1 * 2/2006 Miller ..... A63B 21/0004 482/124
2008/0119765 A1 * 5/2008 Meckel ..... A61H 1/024 601/34
2011/0040225 A1 2/2011 Gibbons
2014/0349818 A1 * 11/2014 Green ..... A63B 21/1426 482/77

* cited by examiner

MEDICAL LEG SUPPORT ARRANGEMENT ADAPTED TO INCREASE THE RANGE OF MOTION OF A LEG TO AID IN THE HEALING AND STRENGTHENING OF DAMAGED, INJURED AND/OR REPLACED BONE, MUSCLE AND/OR TISSUE OF THE LEG

CROSS-REFERENCE TO RELATED APPLICATIONS

This application is a National Stage filing of PCT/AU2013/001248, filed Oct. 28, 2013, which claims priority to Australian patent application number 2012904685, filed Oct. 29, 2014, each of those references being incorporated herein by reference in their entirety.

FIELD OF THE INVENTION

This invention relates to an arrangement that is adapted to assist in the healing, recovery and/or strengthening of a leg which has been subjected to damage, injury and/or replacement of bone, muscle and/or tissue.

More particularly this arrangement relates to the use of a medical advancement which one can use to assist in the recovery of bone or soft tissue injuries including surgery involving knee replacements so as to enable an efficient, easy to use, progressive and safe means, mechanism and method to allow repetitive back and forth circumferential motion of the leg that will allow an increased range of motion all being achieved without bearing unnecessary weight against the injured portion of the leg.

BACKGROUND ART DISCUSSION

While generally this specification reads in respect to the application of the arrangement in the aiding in the healing and strengthening of the knee after a patient receives surgery such as a total knee replacement or soft tissue reconstructive tissue, the arrangement and the device included as part of the arrangement, should not be read so restrictively as it will also have the ability to heal and strengthen other types of bone, muscle and tissue injury including hamstrings and quadriceps.

When bone, muscle and/or tissue of a leg has been damaged, injured and/or replaced often the recovery is a slow process as the damaged material needs to be healed and strengthened overtime for complete and correct rehabilitation.

The problem is in many instances methods and devices used in conventional healing and strengthening of the damaged leg can exacerbate the problem as the exercise involved can often, even potentially unwittingly, place unnecessary weight and stress upon a particular damaged portion of an injured leg leading to further injury or alternatively methods and apparatuses used to assist in general recovery through exercise often involve expensive and substantial pieces of exercise equipment which makes it difficult for a patient to use conveniently and safely throughout the day.

For example it would be particularly advantageous if rehabilitation of the damaged part of the leg could be completed as easily as possible without interrupting other tasks that the user would be involved in. The easier the rehabilitation process the much more likely it will be followed correctly and completely.

At present there are on the market products available, which could best be described as a type of roller skate wherein the foot would be fastened on the roller skate and such a device assists in the back and forth bending motion of the lower leg, where the user would perform whilst seated to assist in the build-up of movement of a rehabilitating knee, which movement is sometimes referred to as a "seated heel slide".

The problem with such an arrangement is that if appropriate healing and strengthening of the damaged part of the leg is to be achieved there needs to be an increased range in motion where preference is, exercising would involve a build up of movement to maximise the individual extension and flexion.

Devices such as a simple roller skate based rehabilitation arrangement, while offering a platform for a foot to rest upon with wheels so that back and forth action can be achieved, the problem is that there is not a continuous support during that initial and departure periods of ground engagement of the device and therefore the damaged portion of the leg begins to bear weight which potentially leads to further injury.

Accordingly, there still remains a need for a device which is based on the foot resting on a platform with wheels so that a back and forth circumferential action can be achieved however it needs to be configured such that there is continuous support throughout the entire ground engaging action of the foot to the ground including that initial contact wherein the upper part of the heel as well as the base or the posterior portion of the heel contact during departure from the ground.

It is most important that any type of recovery and rehabilitation arrangement offers real recognisable comfort and safety to the user so that they have the confidence in knowing that they will be appropriately supported during the back and forth circumferential motion so to build upon their range of movement as required in order to achieve recovery but to do so without being exposed to weight bearing upon the damaged part of the leg.

Accordingly it is an object of this invention to provide a medical leg support arrangement which is adapted to increase the circular range of motion of the leg that is under recovery and/or rehabilitation wherein the back and forth bending motion of the lower leg that a user would perform whilst seated to assist in the build up of the movement of an injured leg is achieved without bearing unnecessary weight upon the damaged portion of the leg.

It is also an object of this invention to provide an arrangement will able to be conveniently used at home, allow for a smooth transition of movements, assist in straightforward and back motion of the leg to avoid any twisting of the knee, accessible for all ages to use, particularly in regard to the elderly with an easy way to put their foot in and on the device and so forth.

Further objects and advantages of the invention will become apparent from a complete reading of the specification.

SUMMARY OF THE INVENTION

In one form of the invention there is provided a medical leg support arrangement adapted to increase the circular range of motion of a leg to aid in the healing and strengthening of damaged, injured and/or replaced bone, muscle and/or tissue of the leg, said arrangement including:

a main housing having a platform which the foot of a user would rest there upon, said main housing including a fastening means to retain said foot upon the platform of the main housing;

rotatable ground engaging strips on opposing sides of said platform, wherein each rotatable ground engaging strip includes curved and/or arched up distal ends such that when in use weight bearing support of the arrangement is maintained upon initial contact and departure of the arrangement from the ground so as to allow continuous support to the leg during back and forth circumferential motion when ground engaging.

In preference the rotatable ground engaging strips are a curved rail supporting a plurality of wheels.

In preference the device further includes a wheel, pair of wheels and/or a plurality of wheels configured on the underside of the platform supporting the foot of the user at both front and rear sections so that these wheels become in ground engaging contact during posterior and/or anterior foot engagement of the arrangement with the ground as the user completes the circumferential range of motion to the required degree of flexion and/or extension.

In preference the arrangement further includes an adjustable resistance means to limit or restrict the rotatability of the ground engaging strips.

In preference in one embodiment of the invention the adjustable resistance means includes a plurality of mats.

In preference each mat has a varying degree of density and/or traction such that the greater degree of density or traction of the material on the mat results in greater resistance placed upon the rotation of the ground engaging strip.

In preference in an alternative embodiment of the invention the main housing includes means to attach to a resilient cord at either the front or back end of the main housing wherein this resilient cord can then be anchored away from the arrangement such that the degree of resiliency of the cord will determine the amount of resistance placed upon the arrangement during the back and forth action.

In preference there is a plurality of resilient cords with each cord having a different degree of resiliency such that progressive healing and strengthening of the damaged portion of the leg can be completed during the back and forth action by firstly introducing resilient cords of high resiliency so as to allow reduced resistance upon the ground engaging strips and wherein as the damaged portion of the leg begins to heal and/or requires further strengthening, resilient cords with reduced resiliency can be progressively introduced so as to introduce greater resistance upon the rotatably ground engaging strips so as to place quantified force upon the leg during the back and forth action.

In preference the arrangement would include an adjustable fastening means so as to allow feet of different sizes to be restable and fastenable upon the platform of the main housing.

In preference the plurality of wheels supported in the single curved rail of the rotatable ground engaging strip would be a small diameter so that the foot can sit as close as possible to the ground.

Advantageously what has been provided for is a unique recovery and/or rehabilitation device that will enhance a particular leg exercise that involves for the most part a back and forth bending motion of the lower leg that the user would perform whilst seated.

Importantly however this invention provides a means and mechanism wherein this back and forth action can be achieved without bearing weight on the damaged portion of the leg so that the patient or the person under rehabilitation is still able to increase their range of motion in exercises building up to maximum movement of extension and flexion wherein importantly during that ground engagement contact both at the initial and departing points there is still no unnecessary burden or stress placed upon the damaged part of the leg.

Advantageously this simple and safe device is made available, which can be used conveniently during the recovery process and for example can even be applied for use when one is carrying out their general tasks from a desk or table.

The adjustability of the platform means that the arrangement can have the user not even requiring to take their shoe off, once again minimising the inconvenience that is required to complete the relevant exercises so that the appropriate healing and strengthening of the damaged portion of the leg can be maintained and achieved.

By being able to provide an arrangement that can build this kind or range of movement it takes away all the stress and potential risk and cumbersome use of more complex arrangements, resulting in patients being able to achieve the requisite healing and strengthening of their damaged portion of the leg as promptly as possible.

In a further form the invention there is provided a cord attachable to the main housing body at either or both ends, so that the user is able to assist in the range of motion as the leg is brought back and forth in its circumferential motion, by pulling at the cord.

In order now to describe the invention in greater detail a series of preferred embodiments will be described with the assistance of the following illustrations and accompanying text.

DETAILED DESCRIPTION OF THE INVENTION

Figure 1:
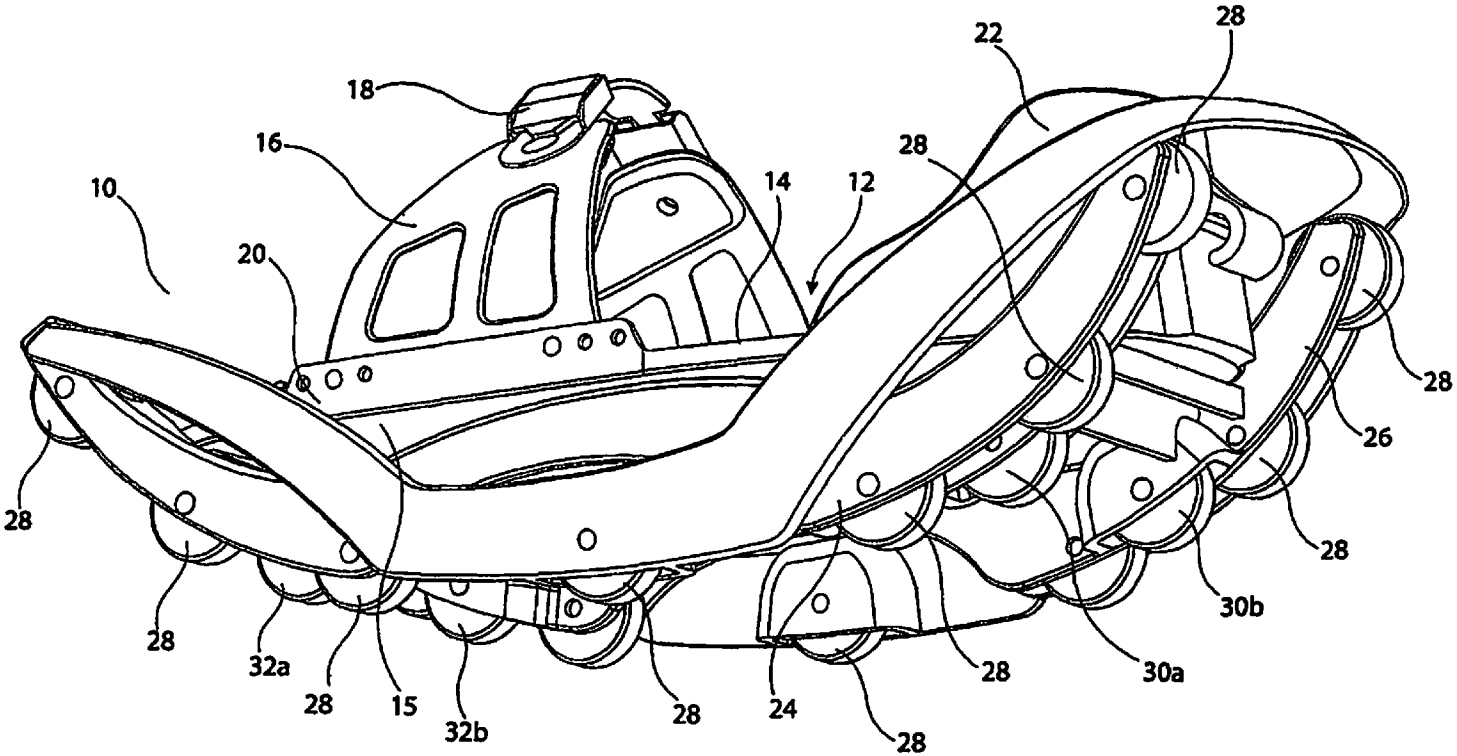
FIG. 1 is a perspective view of the medical leg support arrangement in a preferred embodiment of the invention.

Referring to the drawings now in greater detail wherein FIG. 1 shows a general arrangement of the medical leg support as (10).

The arrangement includes a main housing which has a platform (12) with an upper surface (14) to which the foot of a user can rest thereupon.

The heel brace (22) along with straps (16) and the fastenable clip (18) allows the foot of the user to be retained and secured in place as required upon the platform (12).

The straps (16) can be laterally adjusted along strip (20) as required.

On opposing sides of the platform (12) to which the foot of the user of the support arrangement would be secured thereon are a pair of rotatable ground engaging strips (24) and (26).

These curved strips (24) and (26) provide a rail type mechanism wherein a plurality of wheels (28) can be rotatably supported.

The strips (24) and (26) independently support each wheel (28) such that damage to a particular wheel can result in convenient replacement of a wheel (28) as required.

Also the rail structure of the strips (24) and (26) allow for convenient maintenance and replacement upon the wheels (28) as required.

Also the size of the wheels (28) is such that they will allow the platform (12) which is supporting the foot of the user to get as close as possible to the ground so as to have a more natural rather than an upwardly extended back and forth bending motion of the lower leg during the healing and the strengthening exercise.

In the preferred embodiment the underside of the platform (12) includes a pair of wheels (30*a*) and (30*b*) at the rear of the platform (12) along with corresponding pair of wheels (32*a*) and (32*b*) at the front underside (15) of the platform (12) wherein these pairs of wheels assist in the engagement of the arrangement particularly at initial impact upon the ground and also departure during the curvature or circumferential back and forth motion which will be discussed in greater detail in connection with FIG. 2.

Figure 2:
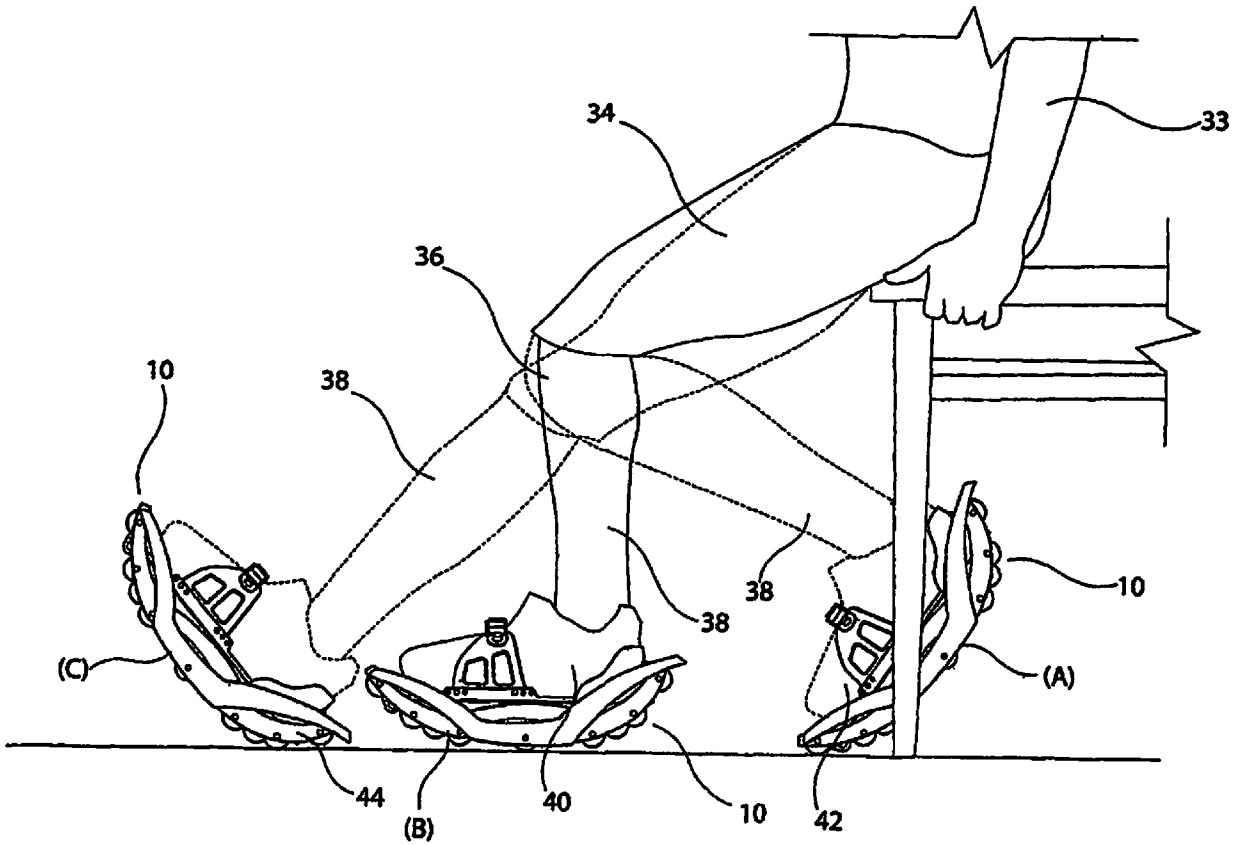
FIG. 2 is a schematic representation showing an application of the use of the medical leg support arrangement of FIG. 1 assisting in the healing and strengthening of a leg under recovery and/or rehabilitation.

In FIG. 2 a user (33) who would be considered a patient or person under recovery who wishes to partake in a safe and convenient back and forth action exercise but in doing so does not wish to inadvertently place any substantial load bearing weight upon the damaged, injured and/or replaced bone, muscle and/or tissue of the leg to which healing and strengthening is required.

FIG. 2 shows the leg (34) of the user (33) during three stages, (A), (B) and (C) of circumferential movement.

The arrangement (10) has allowed the increased range of motion of, in this preferred embodiment, the knee joint so that the exercise will involve a building up of movement with the aim of maximizing the extension and flexion wherein this circumferential range of motion can all be achieved without bearing stress related weight on the knee.

As can be seen in Section A of FIG. 2 represented generally by the number (42), the arrangement (10) even at the initial point of ground engagement, has the rotatable ground engaging strips providing the relevant support so that there is no bearing of stressful weight on the knee joint and the same is the case in Section C of FIG. 2 wherein shown generally as (44) the back curved or arched up end of the rear of the rotatable ground engaging strips are still supporting the damaged leg, whereby the lower leg (38) of the user (33) is able to continue a circumferential rotation with continuous support wherein the knee and leg can be kept straight in line with the body throughout rotation and the ankle (40) being able to stay level throughout the rotation as the foot is continuously supported underneath throughout the ground engagement there is a safe, convenient, efficient means of exercising the damaged leg in order to achieve the necessary recovery or rehabilitation.

Figure 3:
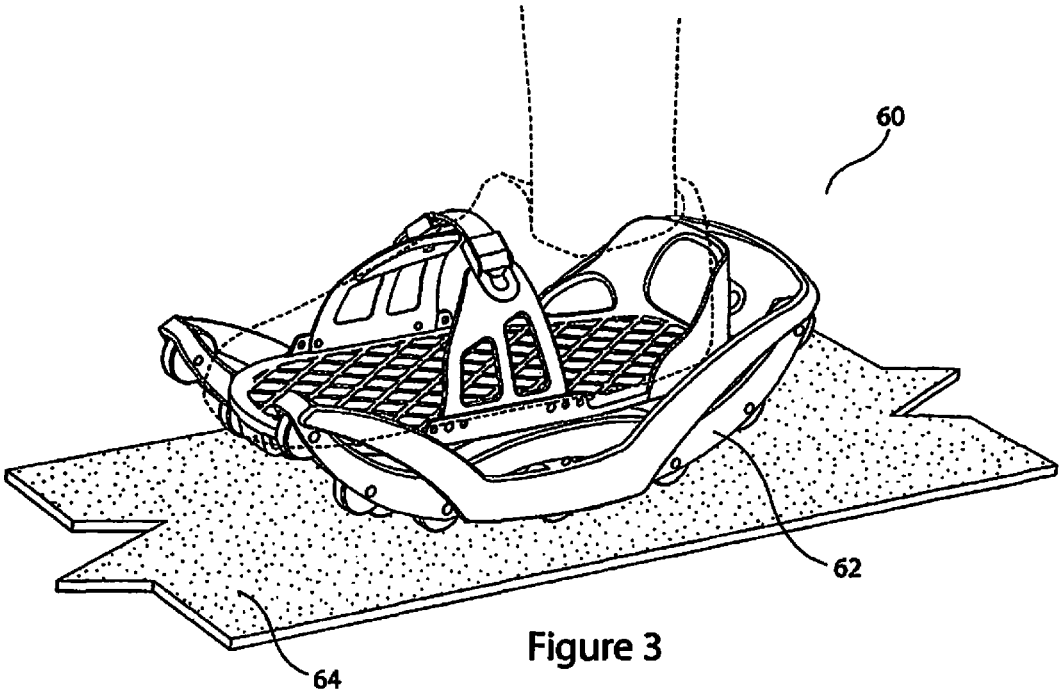
FIG. 3 is a perspective view showing a further preferred embodiment of this invention wherein the arrangement includes a resistive mat to increase the degree of resistance placed upon the ground engaging wheels in order to provide a progressive degree of resistance during the stages of healing and strengthening.

FIG. 3 introduces a further embodiment of the invention shown generally as (60) wherein the leg support arrangement which has been generally described in relation to FIG. 1 now shown as (62) is used in conjunction with a mat (64).

The mat (64) can impart a degree of resistance upon the ground engaging wheels as the back and forth bending motion of the exercise is completed.

Figures 4A, 4B, 4C:
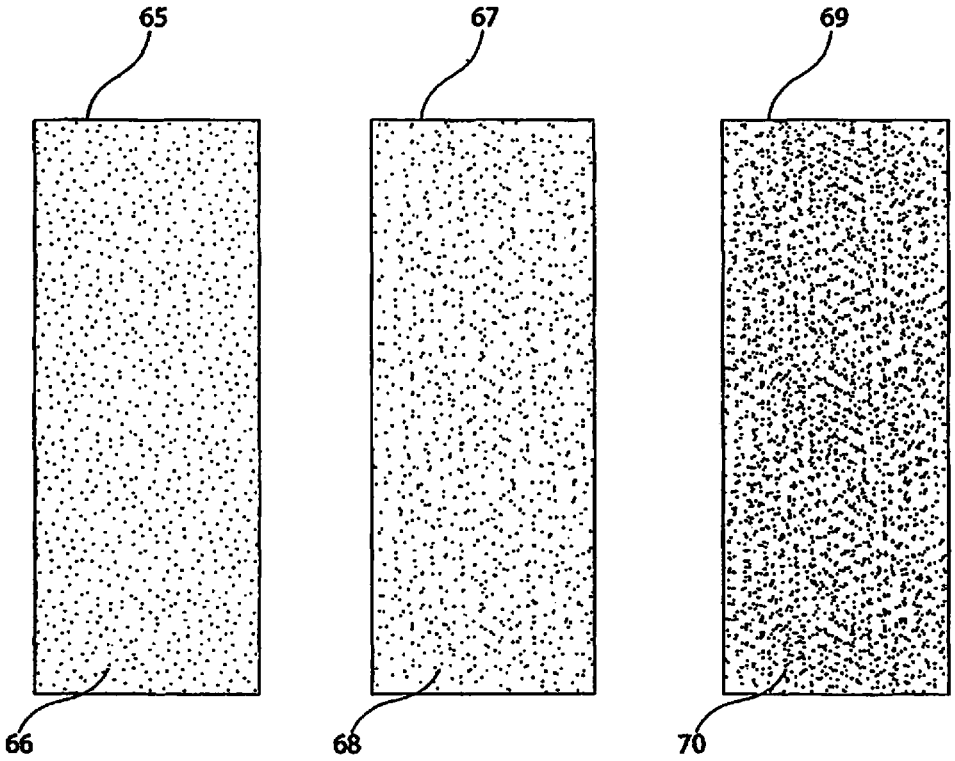
FIGS. 4*a*, 4*b* and 4*c* illustrate mats having a different degree of density and/or traction so as to impart a variable resistive force upon the rotatable ground engaging strips of the medical leg support arrangement.

FIGS. 4*a*, 4*b* and 4*c* illustrate the progressive nature of the resistance or traction that can be imparted on mats (65), (67) and (69) shown schematically by (66), (68) and (70).

Effectively therefore the arrangement can be used with a method of progressive treatment to aid in the healing and strengthening of the damaged leg.

As is to be expected, as the exercise becomes more frequent and comfortable to the user, the strengthening aspect of the exercise can be increased by introducing the features of the resistance mat.

Hence patients can be put on a rehabilitation or recovery program wherein initially they can gain the necessary confidence and ease of use of the leg support without resistive intervention but once the confidence has been gained and the feeling that the appropriate support is being provided without any weight bearing being placed upon the damaged portion of the leg, in order to enhance the healing and strengthening process, the degree of resistive interaction between the main housing unit to which the foot rests thereupon and the mat through the interaction between the ground engaging wheels can be progressively increased.

FIGS. 4*a*, 4*b* and 4*c* show the way in which the degree of resistance or traction can be increased upon the mat but is to be appreciated that a variety of different types of materials having their own inherent means to impart a resistive control upon the rotatable ground engaging strips could be applied.

The scope of this invention is, and would encompass, such considerations.

Figure 5:
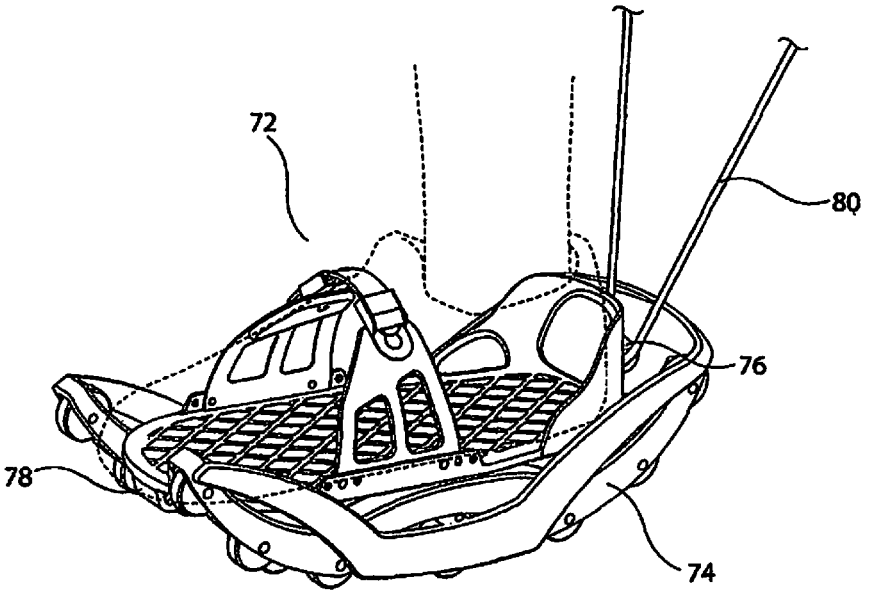
FIG. 5 is a schematic representation of a further preferred embodiment of the invention associated with the use of a resistive means to impart varying degrees of resistance upon the rotatable ground engaging strip wherein in this instance a resilient cord is referenced.

FIG. 5 shows a further preferred embodiment of the invention associated with introducing a resistive means upon the ground engaging capabilities of the leg support shown generally as (72).

The main housing unit (74) has fastening points (76) and (78) at the back and front of the unit (74) wherein a resilient cord (80) can be fastened thereon and where the other end of the resilient cord (80) would be anchored at some appropriate point.

As in the embodiment shown in FIG. 3 and FIGS. 4*a*, 4*b* and 4*c*, the use of the resilient cord (80) offers a means in which resistive forces can be progressively introduced on the ground engaging wheels so as to provide a progressive means in aiding and continuing the healing and strengthening required during an established recovery or rehabilitation program to enhance the injured leg during the back and forth exercising using the leg support.

In this embodiment as further strengthening is required after general use of the leg support the resiliency of the cord (80) can be reduced so that the resistive aspect during the circumferential rotation of the exercise for the range of motion building up to maximum individual circumferential movement can be increased.

By having fastening points (78) and (76) at both the front and rear of the main housing support unit (74) means that the resilient cord (80) can be connected and then fastened to an anchor point, either conveniently at the front or back of the user, once again providing a functionality that the use of this arrangement by the person seeking appropriate recovery and/or rehabilitation can be achieved as conveniently as possible.

Figure 6A:
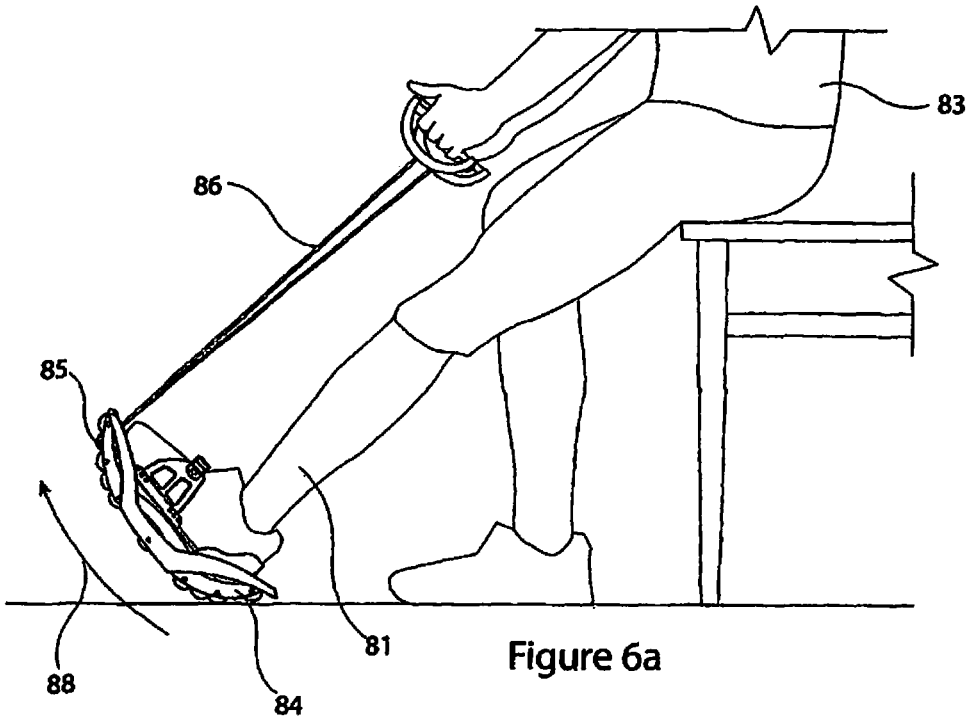
FIGS. 6*a* and 6*b* are schematic representations of a further embodiment of the invention wherein a cord is attached to the main housing so that the user is able to assist in the range of motion as the leg is brought back and forth in its circumferential motion.
Figure 6B:
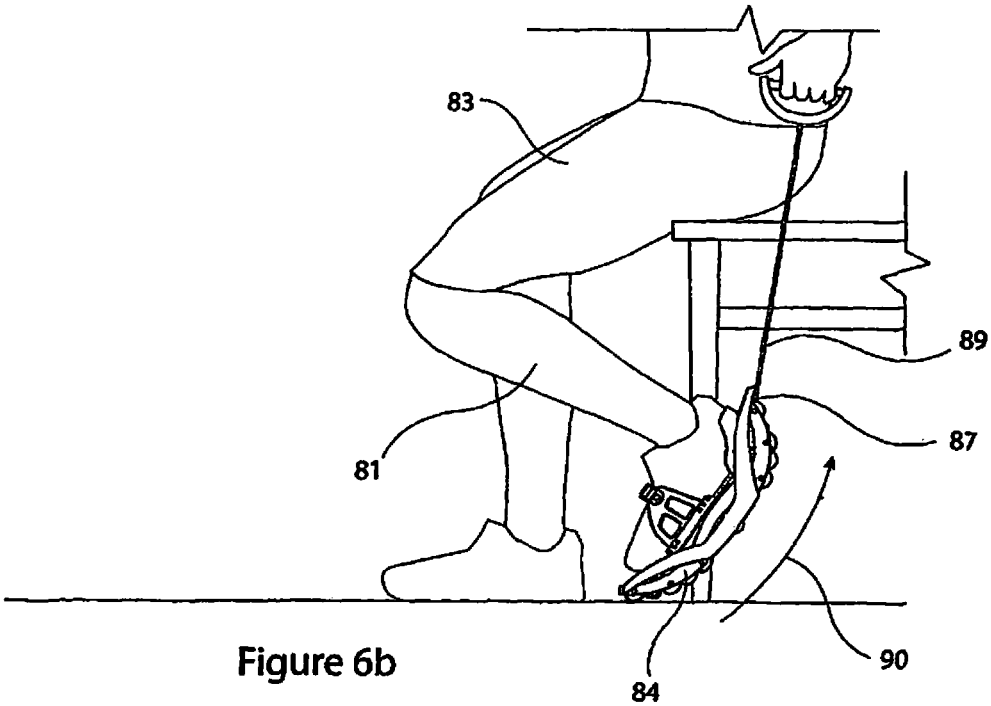

Referring to FIGS. 6*a* and 6*b* wherein a further embodiment of the invention is illustrated wherein a cord shown as (86) in FIG. 6*a* is attached at (85) to the main housing body (84) of the arrangement and in FIG. 6*b* the cord (89) is attached at (87) to the main housing body (84).

In this further embodiment shown in FIGS. 6*a* and 6*b*, the user's (83) foot (81) will still comfortably rest upon the platform of the main housing body (84) however to assist in the range of motion as the leg is swung either back or forth, as shown in FIG. 6*a* user (83) can grasp the cord (86) and assist in pushing the arrangement during the extended or forward circumferential range of motion as illustrated through the use of arrow (88).

In FIG. 6*b* the cord (89) could be attached to the rear (87) of the main housing (84) and once again the user (83) could engage the cord (89) and assist in the movement of the motion of the leg shown by way of arrow (90).

Advantageously in this further embodiment shown in FIGS. 6*a* and 6*b*, the user themselves can increase their participation in proactively trying to assist in inducing the required range of motion as the leg moves back and forth in its circumferential motion.

The cords (86) and (89) allow the user to, in a sense, to push or pull the device as required which could be particularly advantageous during initial build up of movement when initial confidence and assistance is required by the user as they begin their rehabilitation and/or recovery program.

Figure 7:
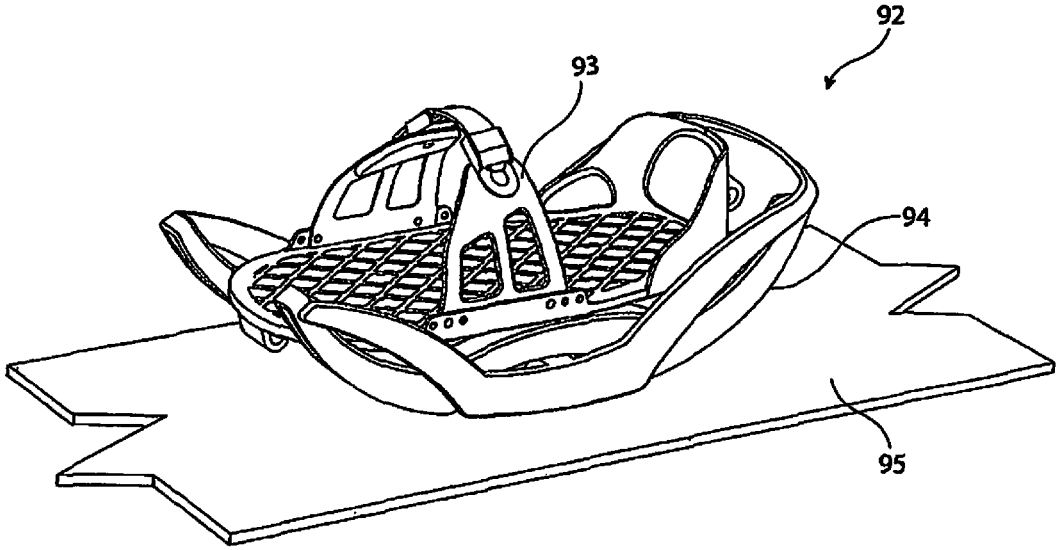
FIG. 7 is a schematic representation of a further embodiment of the invention wherein an alternative method of ground engagement is shown.

FIG. 7 is a schematic representation of a further embodiment of the invention, shown generally as (92) wherein an alternative method of ground engagement is shown. For the most part the housing (93) of the arrangement is the same however the strips (94) are the ground engagement contact with the mat (95). As is to appreciated other ground engagement means could include caterpillars, slides, blades, rollers and so forth.

The claims defining the invention are as follows:

1. A medical leg support arrangement adapted to increase the circular range of motion of a leg of a user, when seated, to aid in the healing and strengthening of impaired musculoskeletal tissue of the leg of the user, said arrangement including:

a main housing having a flat platform with an upper surface such that a foot of the user is flatly restable upon said upper surface of said flat platform;

said main housing including a fastening means to retain and secure in place the flatly rested foot of the user upon the upper surface of said flat platform;

a pair of rails supporting a plurality of rotatable ground engaging rail wheels located on opposing sides of said flat platform, wherein each of said pair of rails includes a front curved distal end that curves up above the upper surface at a front end of the flat platform, and a rear curved distal end that curves up above the upper surface of a rear end of the flat platform, wherein one of said plurality of rotatable ground engaging rail wheels is positioned entirely above the upper surface at the front end of the flat platform and proximate to said front curved distal end, and one of said plurality of rotatable ground engaging rail wheels is positioned entirely above the upper surface at the rear end of the flat platform and proximate to said rear curved distal end such that, when in use, weight bearing support of the arrangement is maintained upon initial contact and departure of the arrangement from the ground so as to allow continuous support to the leg of the user during back and forth circumferential motion instigated by the user when ground engaging the arrangement.

2. The medical leg support arrangement of claim 1 further including at least one ground engaging platform wheel mounted into an underside of said flat platform at each of the front and rear ends of said flat platform.

3. The medical leg support arrangement of claim 2 further including a mat restricting the degree of rotatability of the plurality of rotatable ground engaging rail wheels when said plurality of rotatable ground engaging rail wheels are ground engaging upon said mat.

4. The medical leg support arrangement of claim 2 further including a plurality of mats, each separately employable for restricting the degree of rotatability of the plurality of rotatable ground engaging rail wheels when said plurality of rotatable ground engaging rail wheels are ground engaging upon one of said plurality of mats, wherein each one of said plurality of mats has a varying degree of density and/or traction such that the greater degree of density or traction of the material of each one of said plurality of mats results in greater resistance placed upon the rotation of the plurality of rotatable ground engaging rail wheels.

5. The medical leg support arrangement of claim 1 wherein the main housing includes means to attach to a resilient cord at either a front section or a back section of the main housing wherein said resilient cord, once attached, is adaptable to be anchored away from the arrangement such that the degree of resiliency of the cord will determine an amount of resistance placed upon the arrangement during back and forth circumferential motion of the arrangement instigated by the user when ground engaging.

6. The medical leg support arrangement of claim 5 including a plurality of resilient cords wherein each of said plurality of resilient cords has a different degree of resiliency such that progressive healing and strengthening of a damaged portion of the leg can be completed during back and forth circumferential motion of the arrangement instigated by the user when ground engaging by firstly introducing to the user a resilient cord of higher resiliency so as to allow reduced resistance on the plurality of ground engaging rail wheels and wherein as the damaged portion of the leg begins to heal and/or requires further strengthening, one of said plurality of resilient cords with reduced resiliency can be progressively introduced to the user so as to provide greater resistance on the plurality of ground engaging rail wheels so as to place increased quantified force upon the leg during back and forth circumferential motion of the arrangement instigated by the user when ground engaging.

7. The medical leg support arrangement of claim 5 wherein said resilient cord once fixed at a a first end thereof to said front section or back section of the main housing is anchorable at a second end thereof away from the medical leg support arrangement when the medical leg support arrangement is in use by the user and wherein a degree of resiliency of the resilient cord determines an amount of resistance placed upon the medical leg support arrangement when in use by the user.

8. The medical leg support arrangement of claim 1 further including an adjustable fastening means so as to allow feet of different sizes to be retained and secured upon the upper surface of the flat platform of the main housing.

9. The medical leg support arrangement of claim 1 wherein the plurality of ground engaging rail wheels are of a diameter such that the foot of the user flatly restable upon the flat platform of the main housing flatly rests upon the upper surface of the flat platform as close as possible to the ground.

10. The medical leg support arrangement of claim 1 wherein the main housing includes means to attach an assist cord at either a front section or a back section of the main housing, and said assist cord, once fixed at a first end thereof to said front section or back section of the main housing, is graspable by the user at a second end thereof so that the user is able to assist in the range of motion of the leg during back and forth circumferential motion of the arrangement instigated by the user when ground engaging, by pulling at said assist cord.

* * * * *